US006921313B2

(12) United States Patent
Yu

(10) Patent No.: US 6,921,313 B2
(45) Date of Patent: Jul. 26, 2005

(54) ILLUMINATED FLYING TOY

(76) Inventor: Derrick Yu, 4Fl., No. 73, Alley 21, Lane 135, Jijin 1st Rd., Anle Chiu, Keelung (TW), 110

( * ) Notice: Subject to any disclaimer, the term of this patent is extended or adjusted under 35 U.S.C. 154(b) by 168 days.

(21) Appl. No.: 10/366,552

(22) Filed: Feb. 14, 2003

(65) Prior Publication Data

US 2004/0161999 A1 Aug. 19, 2004

(51) Int. Cl.[7] ..... A63H 27/127
(52) U.S. Cl. ..... 446/39; 446/485; 446/47
(58) Field of Search ..... 446/36, 37, 38, 446/39, 40, 41, 42, 43, 44, 45, 485, 46, 47, 48

(56) References Cited

U.S. PATENT DOCUMENTS

| | | | | | |
|---|---|---|---|---|---|
| 4,165,580 | A | * | 8/1979 | Miura | 446/46 |
| 4,307,538 | A | * | 12/1981 | Moffitt | 446/47 |
| 4,515,570 | A | * | 5/1985 | Beltran | 446/47 |
| 5,181,876 | A | * | 1/1993 | Chen et al. | 446/47 |
| 5,591,062 | A | * | 1/1997 | Hettinger | 446/46 |
| 5,611,720 | A | * | 3/1997 | Vandermaas | 446/47 |
| 5,676,988 | A | * | 10/1997 | Coleman et al. | 446/47 |
| 5,720,651 | A | * | 2/1998 | Chien | 451/95 |
| 5,873,761 | A | * | 2/1999 | Johnson | 446/47 |
| 6,030,272 | A | * | 2/2000 | Hu | 446/233 |
| 2002/0098768 | A1 | * | 7/2002 | Kuo et al. | 446/39 |

FOREIGN PATENT DOCUMENTS

| | | | | |
|---|---|---|---|---|
| JP | 05228266 | A | * 9/1993 | A63H/27/00 |
| JP | 2002177658 | A | * 6/2002 | A63H/27/30 |

* cited by examiner

*Primary Examiner*—Derris H. Banks
*Assistant Examiner*—Urszula M Cegielnik
(74) *Attorney, Agent, or Firm*—Rosenberg, Klein & Lee

(57) ABSTRACT

An illuminated flying toy with an improved propeller that can bring the flying toy to high altitude. The illuminated flying toy provides a dazzling and fantastic effect when played at night. The illuminated flying toy mainly contains a propeller and a launcher. The propeller contains an outer ring, a transparent base plate, a cover and plural blades. The transparent base plate has an illuminating device thereon, a power device thereon for supplying electric power to the illuminating device. The cover is used for covering topside of the transparent base plate. The plural blades radially extend from edges of the transparent base plate to the outer ring. The launcher is adapted to the transparent base plate for launching the propeller. The illuminating device can alternatively be installed on the blades and controlled by a chip installed on the transparent base plate to display various patterns shown at night.

4 Claims, 6 Drawing Sheets

ILLUMINATED FLYING TOY

TECHNICAL FIELD

This invention relates generally to a flying toy with a propeller, in particular, to provide an illuminated flying toy with an improved propeller that can lift the flying toy to high altitudes.

BACKGROUND OF THE INVENTION

A traditional Chinese flying toy called bamboo dragonfly is made of bamboo. The bamboo dragonfly contains two blades extended from one end of a thin rod. The two blades are functioned as a propeller. When a child rubs the thin rod with his palms to make it rotate and release the bamboo dragonfly from his palms immediately, the bamboo dragonfly arises to the air. The child is therefore entertained. However, since the rotating power provided by human palms is little, the flying height is low and the flying distance is short.

Another traditional flying toy includes a handle portion having an upper end. A spindle is mounted atop the upper end and has a bore extending downwardly therethrough. A rotating rod extends through the bore and into the upper end of the handle to allow relative rotation of the spindle upon the handle. The spindle has a pair of pins extending upwardly therefrom. A propeller portion is coupled with respect to the circular platform of the handle portion. The propeller portion includes an inner circular disk. The inner circular disk has a plurality of radially extending blades integrally formed with a peripheral edge thereof Each of the blades has a predetermined angle of orientation. A length of string is secured to the spindle. The length of string has an end fixedly secured to the spindle with a remainder of the string being wrappedly disposed around the rotating rod just prior to operation of the toy. Operation involves pulling the string while holding the handle still, to rotate the spindle and cause the propeller portion to rotate and lift upward, free of the spindle. However the flying height is still not satisfactory and the flying toy cannot be played at night since it's not visible at night.

SUMMARY OF INVENTION

It is therefore primary objective of the present invention to provide a flying toy that can fly higher than traditional similar flying toys.

Another object of the invention is to provide an illuminated flying toy that can be played at night.

Further object of the invention is to provide a dual function flying toy that can also be played on the ground.

The present invention, briefly summarized, in one embodiment discloses an illuminated flying toy. The illuminated flying toy mainly contains a propeller and a launcher. The propeller contains an outer ring, a transparent base plate, a cover and plural blades. The transparent base plate has an illuminating device thereon, a power device thereon for supplying electric power for the illuminating device. The cover is used for covering topside of the transparent base plate and protects devices thereon. The plural blades radially extend from edges of the transparent base plate to the outer ring. The launcher is adapted to the transparent base plate for launching the propeller. The illuminating device can alternatively be installed on the blades and controlled by a chip installed on the transparent base plate to display various patterns shown at night.

BRIEF DESCRIPTION OF DRAWINGS

The invention will be more clearly understood after referring to the following detailed description read in conjunction with the drawings wherein.

DETAILED DESCRIPTION OF PREFERRED EMBODIMENTS

Figure 1:
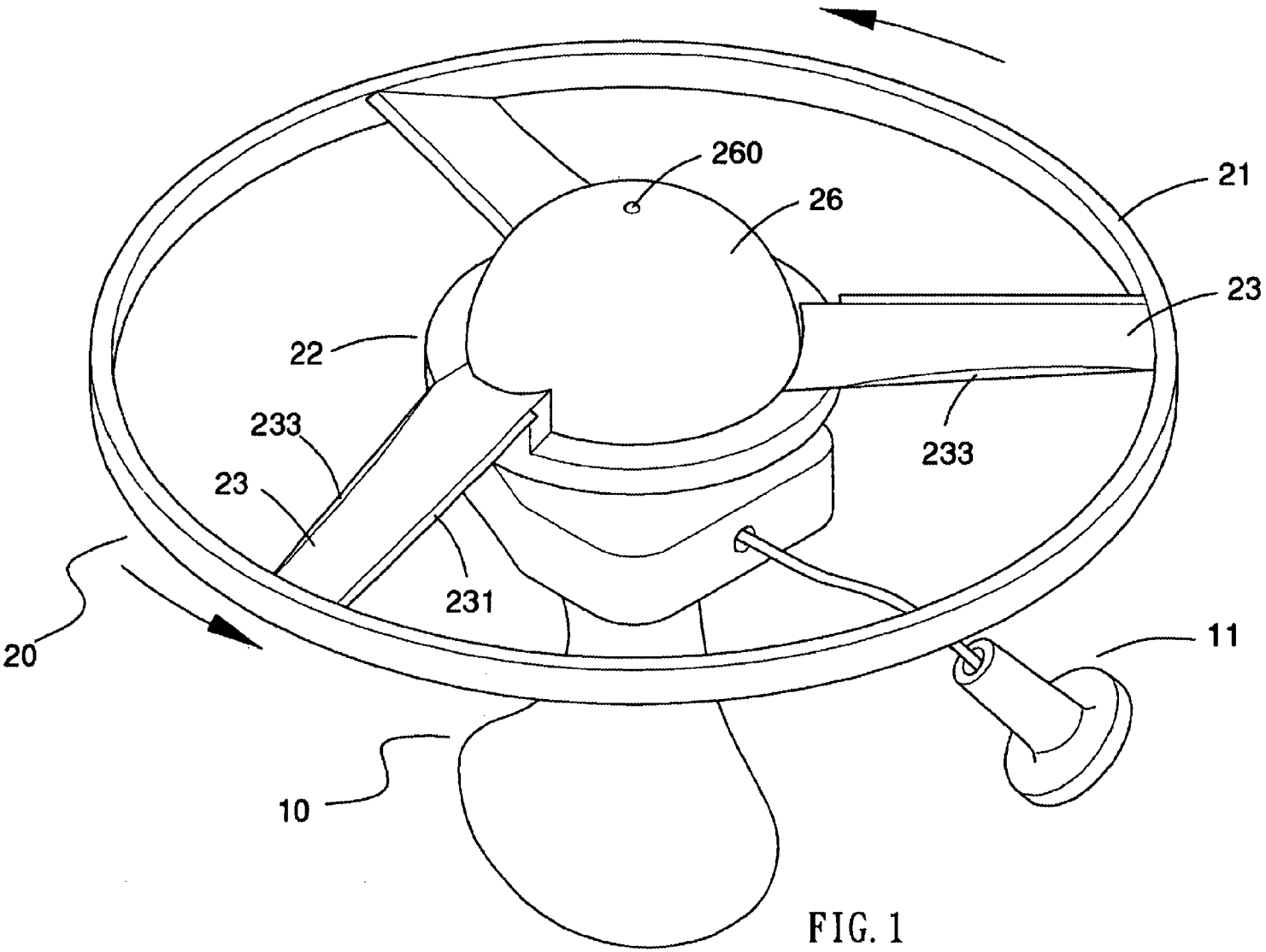
FIG. 1 is a perspective top view of an embodiment.

With reference to FIG. 1 of the drawings, an embodiment of the invention, which is an illuminated flying toy is illustrated as shown. The illuminated flying toy mainly contains two portions: the launcher 10 and the propeller 20. The string device 11 included in the launcher 10 when pulled instantly provides a torsion force on the propeller 20. The propeller 20 then rotates and escapes from the launcher 10 into air. The launcher 10 can be electrically powered or manually powered as shown in FIG. 1 to provide torsion force.

Figure 2:
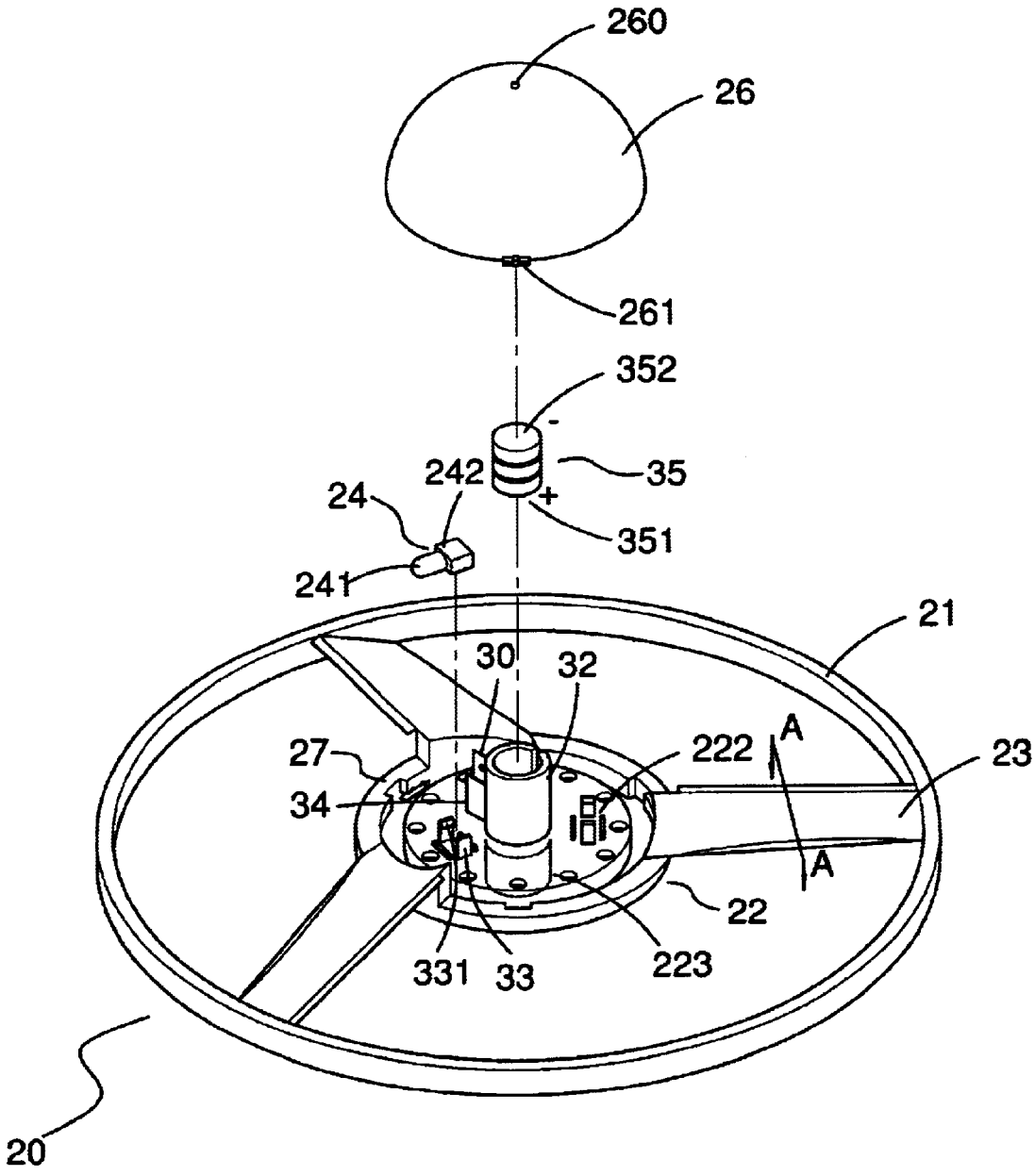
FIG. 2 is an exploded view of the propeller of the embodiment.
Figure 5:
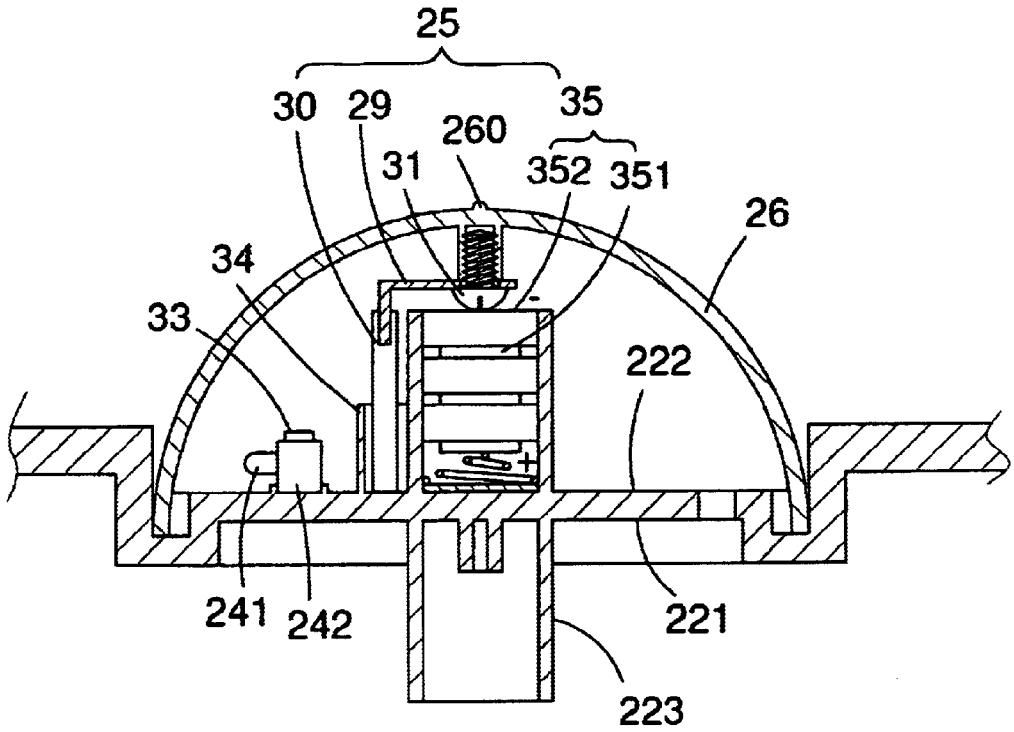
FIG. 5 is a cross sectional view of the propeller of the embodiment.
Figure 6:
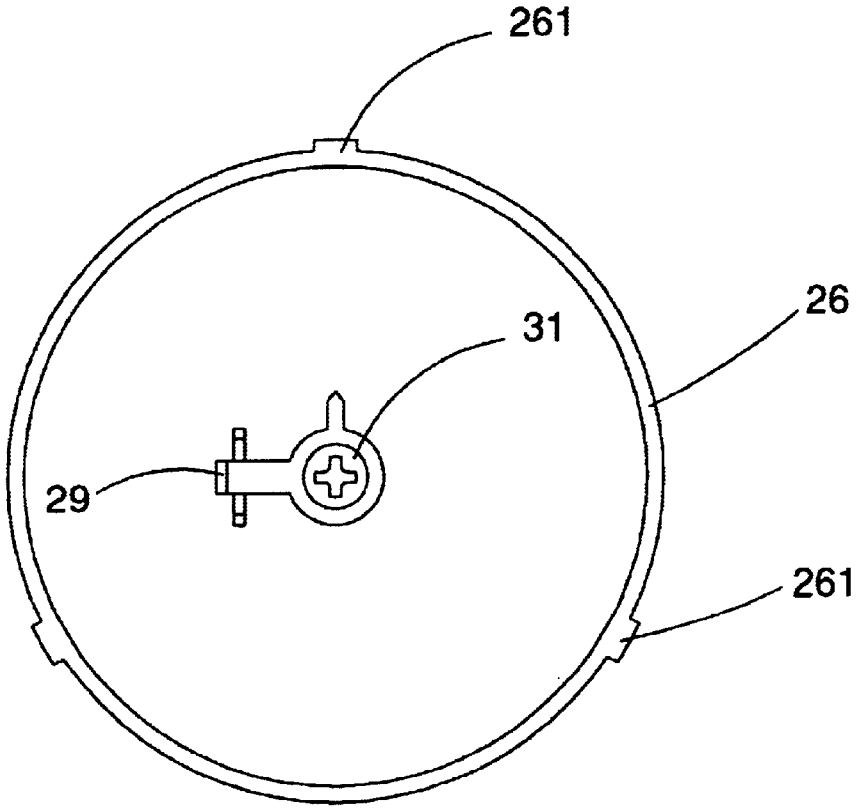
FIG. 6 is a bottom view of the cover of the embodiment.

With reference to FIG. 1, FIG. 2 and FIG. 5, the propeller 20 mainly contains an outer ring 21, a transparent base plate 22, a cover 26 and plural blades 23. The transparent base plate 22 has an illuminating device 24 thereon and a power device 25 thereon for supplying electric power to the illuminating device 24. The cover 26 is used for covering topside 222 of the transparent base plate 22. The plural blades 23 radially extend from edges of the transparent base plate 22 to the outer ring 21. The transparent base plate 22 contains a pipe 223 on its bottom side 221 for being adapted to the launcher 10.

The cover 26 covers and protects all the elements on the topside 222 including the illuminating device 24 and the power device 25. The cover 26 is transparent, so the light emitted from the illuminating device 24 will not be blocked. The light emitted from the illuminating device 24 can be static or blinking depends on the circuit design on the transparent base plate 22.

Figure 4:
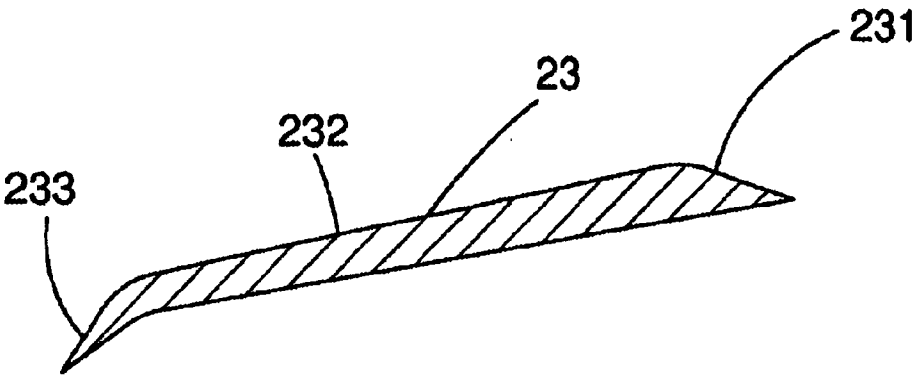
FIG. 4 is a cross sectional of a blade of the embodiment.

With reference to FIG. 4, the blades 23 contains a windward side 231 and a rear side 232 opposite to the windward side, 231 the rear side 232 having a downward portion 233 extending downwardly from the rear side 232 to a distant. When the propeller 20 is rotated by the launcher 10 and rotates in the direction of the arrow shown in FIG. 1, the airflows under the blades 23 are guided by the downward portion 233 to downward direction and therefore provides a upward lifting force. The downward portion 233 therefore greatly improves the flying height of the propeller 20. According to the experiments, the flying height can be raised from 5 meter to 10 meter.

The illuminating device 24 contains: an illuminating element 241 and a base 242, wherein the illuminate element 241 electrically mounted at the base 242 and the base 242 electrically connected to the power device 25. The transparent base plate 22 contains a seat 33 having two hooks 331, wherein the base 242 is adapted to the seat 33 and the two hooks 331 fix the base 242 in position.

Figure 3:
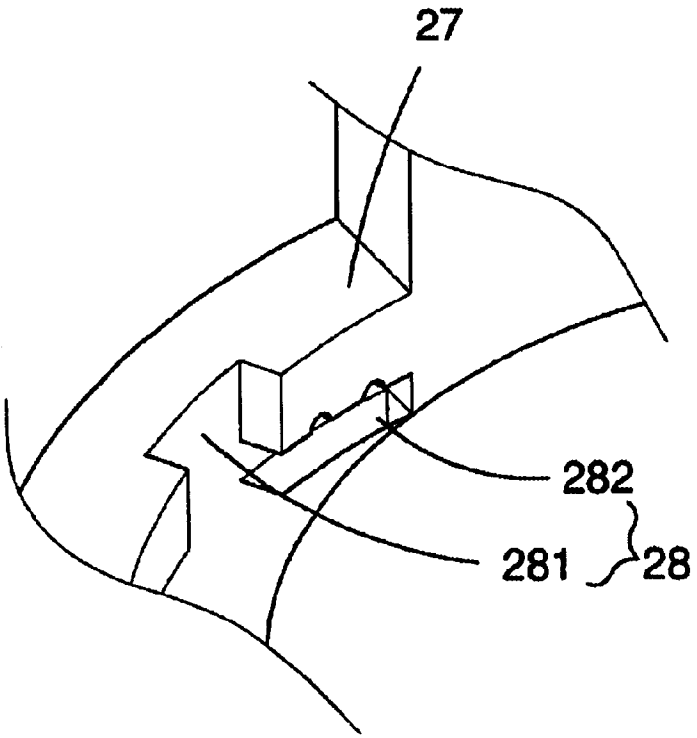
FIG. 3 is an enlarged detailed view of an engaging slot of the embodiment.

With reference to FIG. 2 and FIG. 3, the transparent base plate 22 has a flange 27 on surroundings of the transparent base plate 22. The flange 27 has at least one engaging slot 28. Each of the engaging slots 28 contains an inward opening 281 and a channel 282. The channel 282 extends from edges of the inward opening 281 along the flange 27 to a distant postion and the cover 26 has a least one protrusion 261 on the bottom, wherein each of the protrusion 261 is adapted to engage the transparent base plate 22 through the inward opening 281 and being rotated to an end of the channel 282 correspondingly.

The power device 25 contains: a battery 35, a first conductive plate 29, and a second conductive plate 30. The battery 35 has a positive electrode 351 and a negative electrode 352. The positive electrode 351 is electrically connected to the illuminating device 24. The first conductive plate is mounted at inside of the cover 26 by a bolt 31. The second conductive plate 30 is electrically connected to the illuminating device 24, wherein the first conductive plate 29 is electrically connects to the second conductive plate 30 through the bolt 31 when the cover is tightened. When the cover is tightened, the first conductive plate 29 electrically connects to the second conductive plate 30 and the circuit loop is formed otherwise there is no loop. Thereby the on or off status of the illuminating device 24 can be controlled by tightening the cover 26 or loosing the cover. The transparent base plate 22 further contains a battery holder 32 thereon for holding the battery 35 and a plate holder 34 thereon for holding the second conductive plate 30.

Because of the effect of persistence of vision, when the propeller 20 is flying in the air at night, the light emitted from the propeller 20 is dazzling and fantastic. The propeller 20 after being released from the launcher 10 can easily be located by seeking the light emitted from the propeller 20. The design that the outer ring 21 and the blades 23 are also transparent increases the dazzling effect of the propeller 20. Besides, a speaker or a whistler can be installed on the transparent base plate 22, the outer ring 21, or the blades 23 for providing sounds to increase the entertaining effects.

Figure 7:
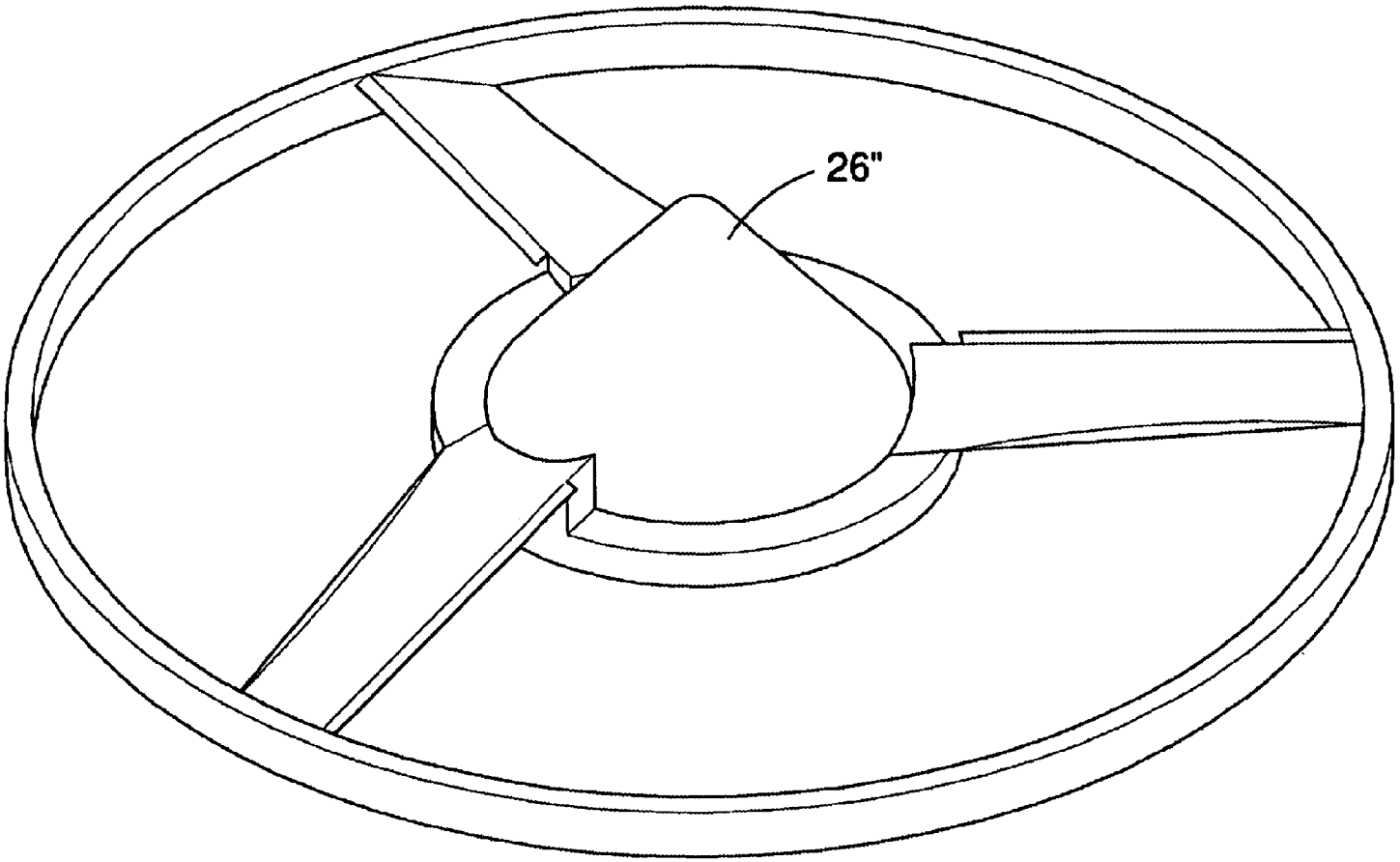
FIG. 7 is a perspective view of a propeller of another embodiment.

In the embodiment, the cover 26 is in the figure of hemisphere. Accordingly if the flying toy is played in the opposite direction of normal direction, the propeller 20 will be ejected to the ground and rotates as a gyro with the top point of the cover 26 as a fulcrum. This is another way of playing the flying toy. As long as the cover 26 has a vertex 260 at the top, the flying toy can be played in a gyro way. Therefore another embodiment of the instant invention, with reference to FIG. 7, contains the cover 26" is in the shape of cone.

Figure 8:
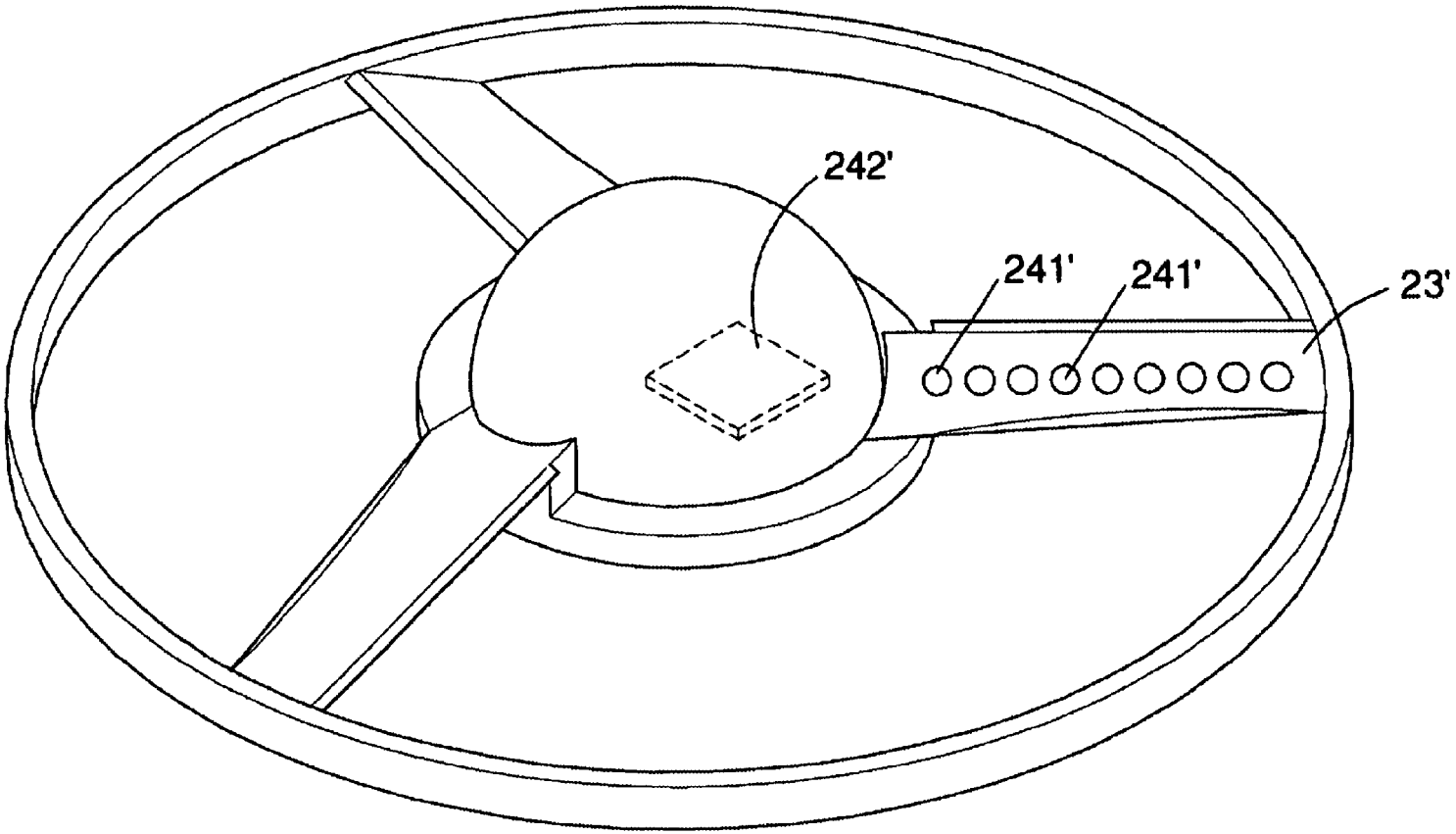
FIG. 8 is a perspective view of a propeller of a further embodiment with illuminating elements on a blade.

Further embodiment of the propeller as shown in FIG. 8 mainly contains an outer ring a transparent base plate, a cover, and plural blades. The transparent base plate has a chip 242' thereon, and a power device thereon electrically connected to the chip 242'. The cover is for covering topside of the transparent base plate. The plural blades 23' radially extend from edges of the transparent base plate to the outer ring, wherein at least one of the plural blades 23' contain plural illuminating elements 241' controlled by the chip 242'.

Because of the effect of the persistence of vision, the light emitted from the illuminating elements forms plural light circles in the air at night. Through the design of the firmware in the chip 242', the chip 242' can control the on or off status of each illuminating elements and the time of illuminating of each illuminating element. Accordingly, various patterns or characters can be formed in the air at night.

Numerous characteristics and advantages of the invention have been set forth in the foregoing description, together with details of the structure and function of the invention, and the novel features thereof are pointed out in appended claims. The disclosure, however, is illustrated only, and changes may be made in detail, especially, in matters of shape, size and arrangement of parts, materials and the combination thereof within the principle of the invention, to the full extend indicated by the broad general meaning of the terms in which the appended claims are expressed.

I claim:

1. An illuminated flying toy comprising:

a propeller comprising:

an outer ring;

a transparent base plate having:

an illuminating device thereon; and a power device thereon for supplying electric power to said illuminating device;

a cover for covering topside of said transparent base plate;

plural blades radially extending from edges of said transparent base plate to said outer ring; and a launcher adapted to said transparent base plate for launching said propeller;

wherein said cover, said outer ring and said plural blades are transparent and said transparent base plate has a flange on surroundings of said transparent base plate, said flange has plural engaging slots, each of said engaging slots comprises an inward opening and a channel, said channel extends from said inward opening along said flange to a distant position and said cover has plural protrusions on the bottom, wherein each of said protrusions is adapted to engage said transparent base plate through said inward opening and being rotated to an end of said channel correspondingly.

2. An illuminated flying toy comprising:

a propeller comprising:

an outer ring;

a transparent base plate having:

a circuit thereon; and a power device thereon electrically connected to said circuit;

a cover for covering topside of said transparent base plate; and plural blades radially extending from edges of said transparent base plate to said outer ring, wherein at least one of said blades comprise plural illuminating elements controlled by said circuit; and a launcher adapted to said transparent base plate for launching said propeller;

wherein said transparent base plate has a flange on surroundings of said transparent base plate, said flange has plural engaging slots, each of said engaging slots comprises an inward opening and a channel, said channel extends from said inward opening along said flange to a distant position and said cover has plural protrusions on the bottom, wherein each of said protrusions is adapted to engage said transparent base plate through said inward opening and being rotated to an end of said channel correspondingly.

3. The illuminated flying toy of claim 2 wherein said power device comprises:

a battery having a positive electrode and a negative electrode, said positive electrode electrically connected to said illuminating device;

a first conductive plate mounted at inside of said cover;

a second conductive plate electrically connected to said illuminating device;

wherein said first conductive plate electrically connects to said second conductive plate when said cover is tightened.

4. The illuminated flying toy of claim 3 wherein said transparent base plate comprises a battery holder thereon for holding said battery and a plate holder thereon for holding said second conductive plate.

* * * * *